United States Patent [19]

Eaton

[11] 4,206,620

[45] Jun. 10, 1980

[54] DUAL MOTOR CARRIAGE DRIVE

[75] Inventor: Homer L. Eaton, Leucadia, Calif.

[73] Assignee: Eaton-Leonard Corporation, Carlsbad, Calif.

[21] Appl. No.: 3,051

[22] Filed: Jan. 12, 1979

[51] Int. Cl.[2] ..... B21D 7/12; B21D 43/12

[52] U.S. Cl. ..... 72/8; 72/307; 72/21; 72/419; 74/27; 74/760; 414/431

[58] Field of Search ..... 72/307, 8, 149, 150, 72/217, 218, 419, 420, 422, DIG. 4, 22; 414/89, 21, 7, 431

[56] References Cited

U.S. PATENT DOCUMENTS

| | | | |
|---|---|---|---|
| 2,429,201 | 10/1947 | Connor et al. | 414/431 |
| 3,145,756 | 8/1964 | Hill | 72/150 |
| 3,299,681 | 1/1967 | Hautau | 72/7 |
| 3,426,562 | 2/1969 | Inda | 72/7 |
| 3,517,844 | 6/1970 | Wloszek | 414/431 |
| 3,557,585 | 1/1971 | Inda | 72/7 |
| 3,949,582 | 4/1976 | Eaton et al. | 72/8 |
| 3,958,440 | 5/1976 | Sassak | 72/307 |
| 3,974,676 | 8/1976 | Eaton | 72/307 |
| 4,022,045 | 5/1977 | Riha | 72/307 X |
| 4,094,426 | 6/1978 | Vogel | 414/431 |

*Primary Examiner*—Milton S. Mehr
*Attorney, Agent, or Firm*—Gausewitz, Carr & Rothenberg

[57] ABSTRACT

A tube bending machine includes a carriage mounting a rotatable chuck for grasping and positioning a length of tube relative to the bending head of the machine. Motion of the carriage along the bed of the machine toward the bending head and rotation of the chuck relative to the carriage are powered by a pair of remotely mounted stationary motors each driving a chain. One chain is connected directly to the carriage and the other engages a sprocket rotatably mounted on the carriage and connected to rotate the chuck. The arrangement provides a differential drive in which the carriage can be driven by operation of both motors and the chuck can be driven by differential operation of the two motors. In addition the chuck can be rotated simultaneously with advance of the carriage.

32 Claims, 9 Drawing Figures

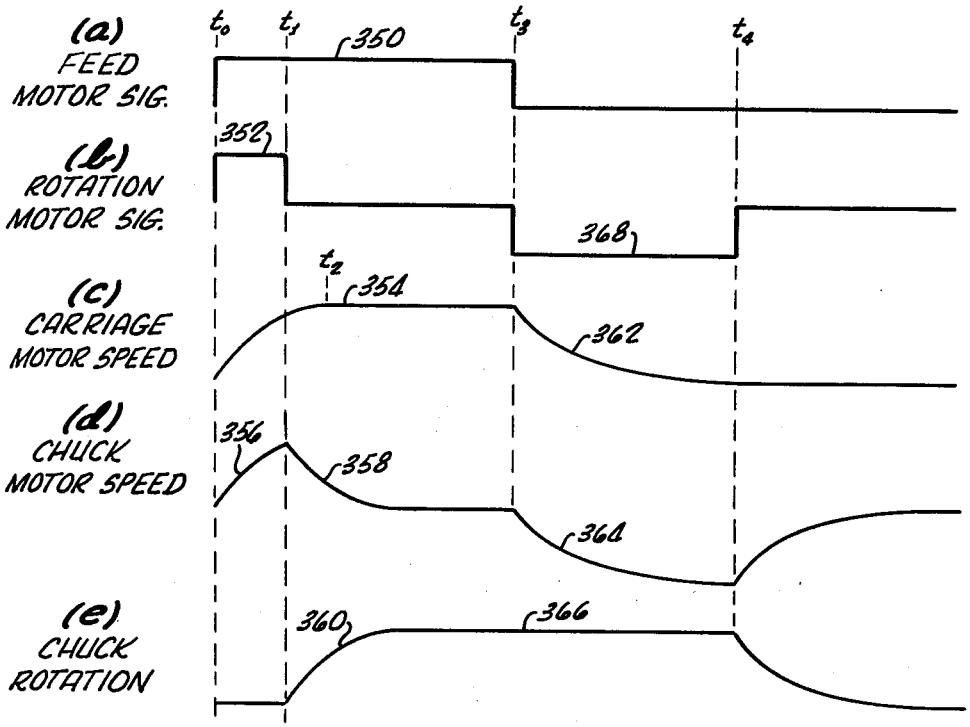
FIG. 6. (+ ROTATION)
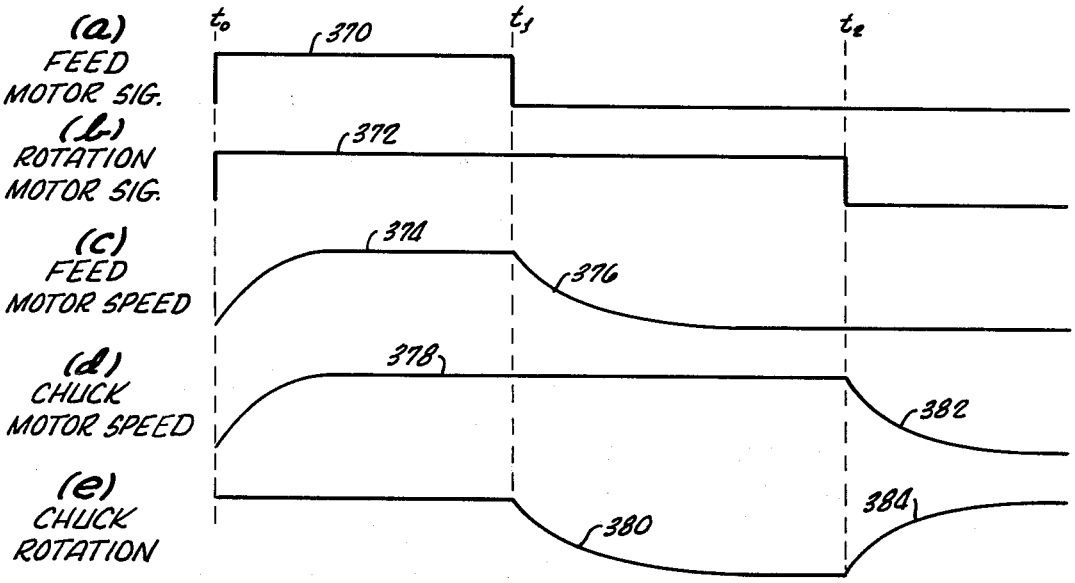
FIG. 7. (−ROTATION)

DUAL MOTOR CARRIAGE DRIVE

BACKGROUND OF THE INVENTION

The present invention is an improvement on the apparatus shown in my prior patent for a Tube Bending Machine and Carriage Therefor U.S. Pat. No. 3,974,676 and in a related prior patent for Positioning Servo and Control Mechanism U.S. Pat. No. 3,949,582. These patents describe improved tube bending machines in which a track mounted carriage carries a rotatable chuck and wherein a single fixed motor is provided to selectively advance the carriage along the track or rotate the chuck relative to the carriage. Selective drive from a single motor is achieved by use of a motor driven chain that engages a sprocket journalled on a carriage and geared to drive chuck. Brakes are provided to selectively stop rotation of the chuck or motion of the carriage so that when one is braked the other is driven.

Because of the selective and alternative nature of the drive of the above-mentioned prior patents, speed of the bending operation is limited by the need to perform tube advancement and rotation in sequence. In this arrangement the carriage is first advanced, without rotation of the chuck, and upon attainment of the desired longitudinal position, rotation to the selected plane of bend is accomplished. Furthermore, as speed of operation is increased, limits of machine components are approached so that for maximum speed of operation various drive components may be severely strained.

Accordingly, it is an object of the present invention to avoid or minimize above-mentioned problems.

SUMMARY OF THE INVENTION

In carrying out principals of the present invention in accordance with a preferred embodiment thereof a first driven member movable along a path has a drive wheel journalled thereon and a second driven member is movably mounted on the first member. Means are provided between the drive wheel and the second driven member for moving the latter in response to rotation of the drive wheel and an elongated drive member is provided in driving engagement with the drive wheel. A second drive member is coupled to the first driven member so that the latter may be moved along the path by like components of motion of the first and second drive members and the second driven member may be moved relative to the first driven member by differential motion of the drive members. In a specific embodiment of the invention that has been mechanized the first driven member is a carriage movable on the body of a bending machine having a bending head mounted adjacent the body. The second driven member is a chuck journalled on the carriage for grasping and rotating a workpiece. There is provided a first elongated driven element and a first drive means is coupled therewith for independently rotating the chuck or moving the carriage. A second elongated driven element is coupled with a second drive means for moving the carriage along the body. This provides a mechanical differential action whereby the carriage may be moved by equivalent velocities of the two driven elements and the chuck may be rotated when the two velocities are different. According to a feature of the invention the elongated driven elements are separate chains that are individually powered by separate stationary motors. According to another feature, compensation is provided for response of the chuck to operation of one of the chains so that the chuck is effectively operated by only one of the claims despite the mechanical differential action.

BRIEF DESCRIPTION OF THE DRAWINGS

FIGS. 6 and 7 are synchrographs illustrating the dual motor operation.

Figure 1:
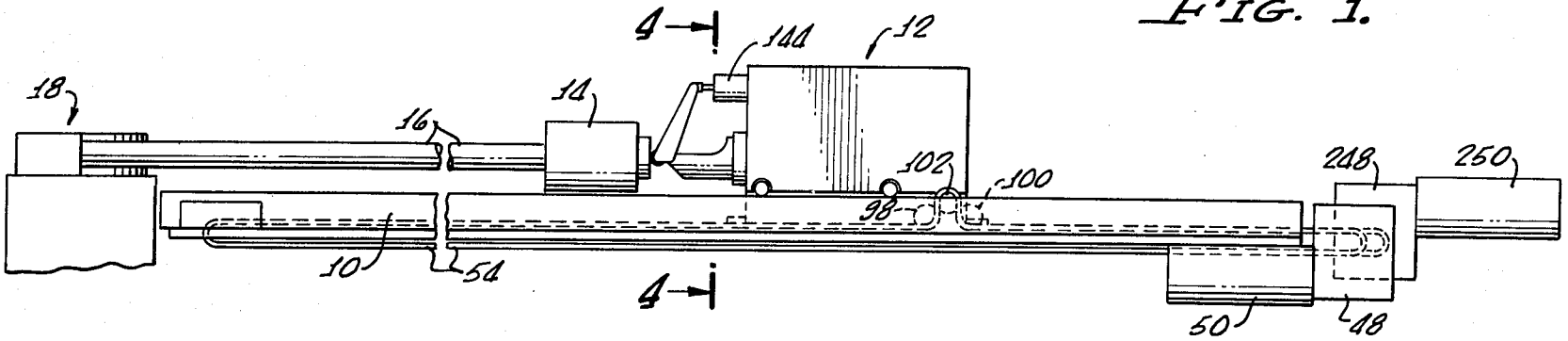
FIG. 1 is a side view of a bending maching embodying principles of the present invention.
Figure 3:
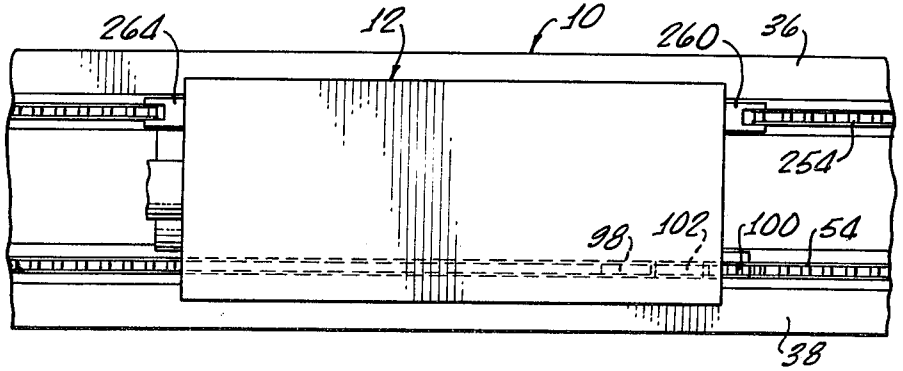
FIG. 3 is a plan view of the carriage and chain connections of the machine of FIG. 1.

The bending machine illustrated in FIG. 1 may be identical to the machine illustrated in U.S. Pat. Nos. 3,949,582 and 3,974,676 except for the specific arrangement of the carriage and chuck drive. In fact, as will be readily appreciated as the description proceeds, the machine of the prior patent may be modified to incorporate principles of the present invention merely by adding an additional motor, gear box and chain and providing modified motor controls.

Briefly, the machine comprises a fixedly supported elongated bed 10 having a moving carriage assembly 12 that carries a rotatable chuck 14. The latter grips a tube 16 which is to be advanced and rotated for preselected positioning with respect to bending dies carried by a machine bending head generally indicated at 18. For a bending operation the carriage advances the tube and the chuck rotates the tube for longitudinal and rotational positioning with respect to dies forming part of the bending head. These dies will clamp a portion of the tube and rotate therewith about a substantially vertical axis in the illustrated arrangement to accomplish a tube bend. Thereafter at least some of the dies are withdrawn from the tube, the carriage is advanced (withdrawing the tube from other dies) and the chuck is rotated to properly position the tube for the next bend. A conventional mandrel (not shown) may be inserted into the tube prior to each bend and properly positioned with respect to the area to be bent. Thereafter the mandrel is withdrawn by means of a substantially conventional mandrel extracting mechanism (not shown).

Figure 4:
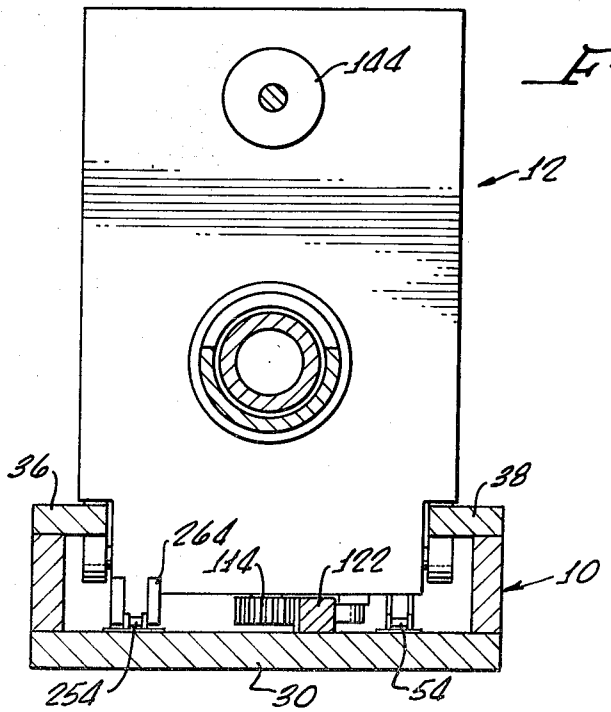
FIG. 4 is a vertical section taken on lines 4—4 of FIG. 1.

In the illustrated embodiment of the present invention the machine bed 10 carries a substantially U-shaped elongated rail assembly 30 (FIG. 4) having oppositely disposed and inwardly projecting flanges 36, 38 to form rails or tracks for the carriage.

Mounted at one side of the machine bed adjacent the rearward end thereof is a stationary motor 50 that drives via a gear box 48 and clutch 46, a first chain sprocket 44 that is mounted on a stationary axis. An elongated drive tension member in the form of an endless flexible chain 54 (FIG. 2) is entrained over sprocket 44 and also over a sprocket 52 rotatably mounted on a fixed axis at the forward end of the machine body. Chain 54 is engaged with a pair idler sprockets 98, 100 journalled on the carriage and also with a drive wheel or sprocket 102, also journalled on the carriage between the idler sprockets and connected to a shaft 104 that drives a chuck power gear 162 by means of gears 164, 172 and 174.

A rack 122 fixed to the rail assembly 30 engages gears 114, 116 of carriage brakes 118 and 120. Gear 114 is connected by gears 126 and 128 to drive a carriage position pick-off in the form of an incremental shaft encoder 132.

Chuck brakes 176, 178 are connected to chuck power gear 162 by means of a common gear 180 which also drives a chuck rotation pick-off in the form of an incremental shaft encoder 184.

The chuck is operated to grasp or release an end of the tube 16 by means of a power cylinder 144 and a drive linkage 148, 149 and 154.

All the parts described to this point are part of the bending machine of my prior U.S. Pat. Nos. 3,949,582 and 3,974,676. For further details of the construction, configuration and operation of these parts, reference is made to these patents. However, the operation but not the construction, of the machine is changed significantly by the addition of another motor and another chain driven by such motor.

To provide an improved, faster and more efficient operation of carriage and chuck there is mounted at the rear end of the machine body, on the side opposite motor 50 and gear box 48, a second motor 250 driving a second gear box 248. The latter is connected via a clutch 246 to drive a sprocket 244 rotatably mounted on a fixed axis at the rear of the machine. Entrained over the sprocket 244 is a second elongated drive member or tension member in the form of a second chain 254 which extends along the machine body track and is entrained over sprocket 252 rotatably mounted on a fixed axis at the forward end of the machine. Chain 254 is effectively endless, having its two ends directly fixed to back and front sides, respectively, of the carriage by means of brackets 260, 264. The brackets are fixedly connected to the rear and forward walls of the carriage structure at the side thereof opposite the side that carries the sprocket wheel 102.

With the two chains connected as described, the carriage will be driven (and the chuck is not driven) when the two chains move at the same velocity (i.e., same speed and same direction). When the chain velocities differ from each other (either in speed or direction, or both) the chuck is rotated. A differential type of action is thus provided.

No further mechanical changes other than the described addition of motor, gear box, chain and the driving connection thereof are employed. In fact, simply by disconnecting the motor 250, as by operation of clutch 246, the apparatus can be operated just like the machines of the above-identified patents. However, there is provided a separate feed command position loop for the second motor 250 which command position loop is substantially identical to the rotation command position loop.

Although each control loop is substantially similar to the control loop of the prior patents, the brakes are not employed in the present system for selecting operation of chuck or carriage. Separate feed and rotation commands are provided and interconnected. The feed command position loop is cross connected to the rotation command position loop to provide, in effect, an electrical differential action that compensates for the mechanical differential action.

Figure 5:
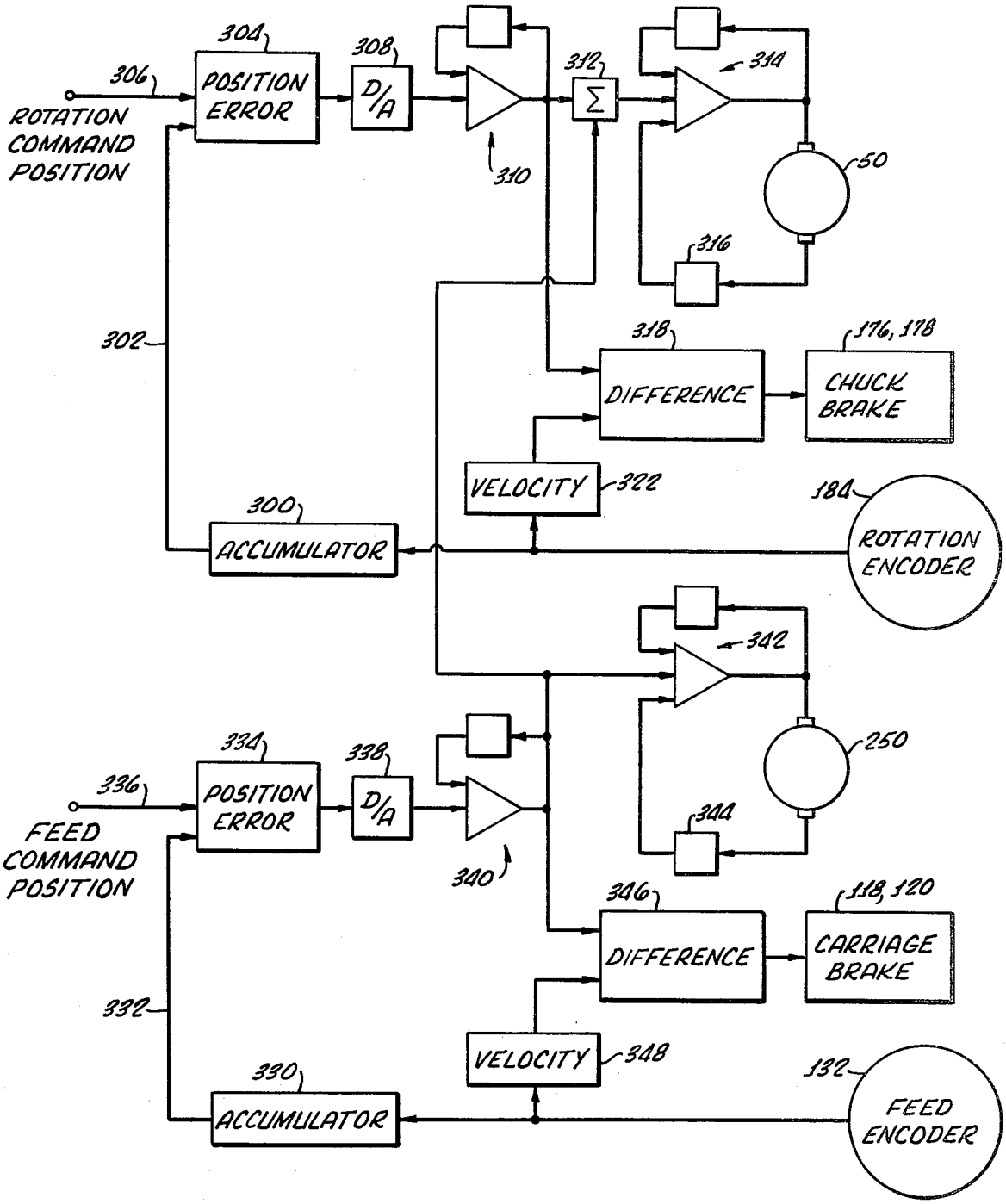
FIG. 5 is a block diagram showing the individual motor control channels and the interconnection therebetween.

Briefly, as shown in FIG. 5, rotation encoder 184 provides a series of incremental rotation position pulses which are fed to an accummulator 300 which effectively integrates the encoder feed back pulses to provide a position feed back signal that is fed via lead 302 as a first input to a difference or position error circuit 304 that receives as a second input a rotation command position signal provided on a line 306. The position error from circuit 304 is fed via a digital to analog converter 308 and via an operational amplifier 310 to an algebraic summing network 312. The output of the latter drives an operational amplifier 314 in the velocity loop of the rotation motor 50. The rotation motor is driven in a closed velocity loop in which a velocity pick-off 316 feeds motor velocity back to the amplifier 314 which drives the motor at a velocity tending to minimize the difference between the commanded motor velocity (the signal received from the summing network 312) and the actual motor velocity (from velocity pick-off 316). The arrangement described is a conventional type I servo in which motor velocity is controlled in accordance with position error which provides a motor velocity command. Rapid attainment of the final position is controlled by the chuck brakes 176, 178 operated in accordance with the output of a difference circuit 318 receiving as a first input the position error signal from the output of amplifier 310. The second input to the difference circuit 318 is the actual rotation velocity signal provided by a circuit 322 that receives the feed back pulses from rotation encoder 184. Operation of this brake control circuit is fully described in the above-mentioned patents.

For the feed motor 250 there is provided a control circuit that is substantially identical to the circuit for control of the rotation or chuck motor 50. Thus, carriage position or feed encoder 132 provides a series of pulses to an accummulator 330 to furnish on line 332 a first input, representing actual carriage position, to a difference or position error circuit 334. Feed (carriage) command position is provided on an input control line 336 whereby carriage position error is fed from the error circuit 334 to a digital to analog converter 338 and thence, via an operational amplifier 340 to an amplifier 342 of the velocity loop of the carriage motor 250. This carriage motor velocity loop includes a velocity pick-up 344 that feeds to the amplifier 342 a feed back signal representing the motor velocity. As in the rotation velocity loop, the amplifier also receives the commanded velocity in the form of feed position error and drives the motor at a speed to minimize the difference between commanded and actual velocity.

A brake circuit similar to the chuck brake circuit and substantially the same as that described in the above-identified patents operates carriage brakes 118, 120 in accordance with the output of a difference circuit 346 that receives a first input as a velocity signal from a velocity circuit 348 which in turn receives the carriage position feed back pulses produced by the encoder 132. The second input to the difference circuit 346 is the carriage or feed command position error provided at the output of amplifier 340. It may be noted that the brakes are employed to insure accurate and rapid positioning of the carriage and of the chuck rotation but, as mentioned above, are not employed for selection of carriage motion or chuck rotation in the present arrangement.

To enable both motors, the chuck motor 50, and the carriage motor 250, to be driven in unison under certain conditions (as will be described below) and to compensate for the response of chuck rotation to operation of the carriage motor 250 (due to differential action) the feed position error signal at the output of amplifier 340 is fed as a second input to the algebraic summing network 312 whereby the signal fed to the velocity loop of the chuck motor 50 is the algebraic sum of rotation command position error and feed command position error.

As previously mentioned the combination of dual chains with one connected to drive the carriage and the other connected to drive the sprocket 102 provides a mechanical differential. Mechanically the operation is readily understood. When the two chains move with the same velocity (speed and direction) the carriage is driven but the chuck is not rotated, whereas when the two chains move with relatively different velocities the chuck is rotated and the carriage may or may not be driven depending upon whether the carriage chain 254 is driven. The chuck may be rotated simultaneously with carriage travel when the carriage chain 254 is driven and the chuck chain 54 is either at rest or driven at a different velocity.

However, direct control of the two desired motions, carriage travel and chuck rotation, cannot be achieved simply by controlling each motor individually without regard to operation of the other. This is so because the differential action of the mechanism causes carriage motion to change the response of the chuck to rotation of the chuck motor 50. In other words, when carriage motor 250 is not operating and, therefore the carriage is stationary, operation of chuck motor 50 will result solely in rotation of the chuck. Thus, with the carriage stationary there is a direct correspondence between chuck rotation and rotation of the chuck motor 50. However, when the carriage is moving the response of the chuck to rotation of the chuck motor is changed because of the differential action. If the carriage chain 254 and the chuck chain 54 are both moving in the same direction, the rotational speed of the chuck in response to operation of chuck motor 50 is decreased by the motion of the carriage. If the two chains are moving in opposite directions the rotational speed of the chuck in response to the chuck motor 50 is increased. To enable a chuck command to produce only chuck rotation and a carriage command to produce only carriage motion it is necessary to compensate for these effects.

In order to compensate for the effects of the mechanical differential action, effects that change the rotational response to the chuck to its drive motor 50, the two control channels are cross connected by algebraically combining the feed position error with the rotation position error in summing network 312. This arrangement in effect provides a compensatory electrical differential which changes the signal fed to the chuck motor in such a manner as to overcome the effects of the mechanical differential. Thus, a rotation command signal fed to the chuck motor will produce a predetermined amount of rotation regardless of carriage motion. A separate signal commanding a carriage motion is also fed to the summing network so that the chuck rotation motor is driven according to the difference of the carriage and chuck motor position error signals. If there is no commanded carriage drive, the chuck is driven solely by the chuck position error signal. If a carriage drive is commanded during chuck rotation, the carriage motion operates, via the mechanical differential, to decrease or increase chuck rotation depending upon relative directions. However, in such case the carriage motor drive signal is algebraically combined with the chuck rotation error signal and increases or decreases the drive signal to the rotation motor. This changes rotation motor speed by amount equal and opposite to the change in chuck rotation speed that otherwise would result mechanically from drive of the carriage. In effect, the algebraic summing network 312 may be viewed as an electrical differential that compensates from the mechanical differential so as to allow chuck rotation to be controlled solely by chuck command and carriage position to be controlled by carriage command.

With this cross coupling of the two control loops it will be seen that in the absence of chuck rotation the carriage command signal drives both the carriage motor 250 and the chuck motor 50. Thus, there is a precise coordination of the two motors and, importantly, both motors drive the carriage.

As a consequence of the electrical differential action which permits independent control of chuck and carriage, an important advantage accrues. Both motors may operate in unison to drive the carriage in the absence of a rotation command. When carriage motion is commanded but chuck motion is not commanded, and if in such case the chuck motor were not to be rotated, there would be a differential motion of the two chains, the carriage chain being driven and the chuck chain being stationary. This would cause unwanted chuck rotation in response to the carriage drive. However, the electrical differential action, which feeds to the chuck motor a signal proportional to the difference between the desired motion of chuck and carriage, operates in such a case to drive the chuck chain 54 at the same speed and in the same direction as the carriage chain 254 is driven. Thus, the power of both motors is applied equally to drive the carriage and no chuck rotation occurs.

With the two motors operating in unison (as for increased power of carriage drive), decreasing the speed of the chuck motor causes positive chuck rotation, whereas decreasing speed of the carriage motor causes negative chuck rotation.

Typical operations of the described apparatus for positive chuck rotation and for negative chuck rotation are illustrated in FIGS. 6 and 7. The curves of FIGS. 6 and 7 are merely illustrative of machine operation. They are not precise representations of the quantities and characteristics depicted but are meant to facilitate exposition and to display qualitative rather than quantitative features of operation of the described apparatus. Positive chuck rotation may be defined for the purposes of this invention as the direction of chuck rotation in which the chuck can be rotated while the carriage is being advanced toward bend head. In the embodiment of FIGS. 1–8 the chuck can be rotated only in one direction while the carriage is being advanced. For rotation in the other direction carriage advance and chuck rotation must take place in sequence.

For positive chuck rotation feed and rotation motor signals are as shown in curves 350 and 352 of FIGS. 6(*a*) and 6(*b*), respectively. These curves represent the signals at the inputs to the motor velocity loops, namely at the inputs to amplifiers 342 and 314. Curve 354 of FIG. 6(*c*) represents the carriage or feed motor speed that results from the feed motor signal 350. With the step input of curve 350 of the feed motor signal 350 the carriage motor speed increases exponentially from the rise of curve 350 at time $t_0$ to a time $t_2$ at which maximum carriage speed has been achieved. Carriage speed continues at a steady rate at its maximum as long as the feed signal 350 remains at the indicated level. Since the carriage is driven by a direct connection to chain 254 the carriage speed is the same as motor speed. That is, the linear carriage speed is the same as the rotational speed of the carriage motor 250 except for such factors as play in the chain 254 and its connections and chain compliance.

With a step input 352 in the rotation motor signal the rotation motor speed, indicated at 356 in FIG. 6(*d*) increases exponentially until the fall of signal 352 at time $t_1$. In the illustrated example it is desired to drive the carriage for a short distance by both motors before beginning the chuck rotation. Thus, at time $t_1$ the rotation motor signal 352 drops to zero and the rotation motor speed begins to decay exponentially as indicated at curve 358 of FIG. 6(*d*).

When both motors are running in the same direction at the same speed as occurs in the time interval between $t_0$ and $t_1$ both chains are moving in the same direction, the carriage is advancing under the driving force of carriage chain 254 and also under the driving force of chain 54. There is no relative motion between sprocket 102 and the chain which is engaged therewith and thus the advance of both chains in unison achieves a forward drive of the carriage under the driving force of both motors. It may be noted in a preferred embodiment that, during this dual motor drive of the carriage wherein no chuck rotation is desired, chuck brakes 176, 178 are actuated to insure that the chuck does not rotate. Of course, the chuck brakes are released during chuck rotation and used only for final rotation positioning.

During the interval $t_0$–$t_1$ only carriage motion is desired, thus the appropriate feed position command signal is provided on line 336 to the position error circuit. Since no chuck rotation is desired, there is no rotation position command (e.g. this command is zero) on line 306 to the rotation position error circuit. The electrical differential, summing network 312, accounts for the operation of the rotation motor at this time. The feed and rotation position command signals are not shown in FIGS. 6 and 7.

The initial relatively small forward motion of the carriage under the increased driving force of both motors is desired because increased carriage driving forces must be exerted during initial carriage motion in order to effect withdrawal of the mandrel from the tube or to insure removal of the tube from the die grooves into which the pipe has been pressed and somewhat deformed during a prior bend. Once mandrel withdrawal has been started or once the pipe has been driven from the die groove, which requires a distance of about ½ pipe diameter, the increased carriage drive force is no longer required. Now carriage may be driven by but a single motor and therefore the chuck may be driven at the same time as forward motion of the carriage is continued.

Having advanced the carriage for a short distance by the drive of both motors, chuck rotation in the assumed positive direction may now commence. This is achieved by initiating the rotation command position signal on line 306 at time $t_1$, thereby dropping the rotation motor signal 352 of FIG. 6(*b*), since this signal is the algebraic sum of the inputs to the summing circuit 312. Since carriage advance is to continue while the chuck rotates, the feed command position signal and the feed signal are not changed (except as the latter may vary due to operation of the carriage position feedback loop.)

As the chuck motor speed, indicated by curve 358, decreases with respect to the steady carriage motor speed 354, chuck rotation (curve 360, FIG. 6(*c*)) begins at time $t_1$. Chuck rotation increases exponentially with the exponential decrease of chuck motor speed. After chuck rotation attains maximum speed, it continues until there is a change in the relative speeds of the two motors. At time $t_3$ the feed motor signal drops to zero and the carriage motor speed begins to decay as indicated at 362 and reaches zero at a time $t_4$ at which time the carriage has attained its desired position. Assuming that chuck rotation is to continue after time $t_3$, when the rotation motor speed begins to decay, the chuck motor speed must begin to increase, but in the opposite direction, as indicated at 364, so that the difference between the two motor speeds will not change. Thus chuck rotation remains a constant as indicated at 366 even though carriage motor speed decreases. To cause the chuck motor speed to increase in the appropriate direction this motor must be reversed. Thus, the rotation motor signal at the output of summing network 312 changes polarity, as indicated by curve 368 of FIG. 6(*b*). When the chuck motor rotation commences at time $t_1$, the rotation command position signal on input line 306 is initiated to provide the rotation motor signal, which is the algebraic sum of the two inputs of the network 312. At time $t_4$ the rotation motor signal decays to zero and chuck motor speed decays as the actual chuck rotation follows the chuck motor speed.

For carriage advancement with a negative chuck rotation the signals are as illustrated in FIG. 7 in which the feed motor signal 370 rises at time $t_0$ and falls at time $t_1$. The rotation motor signal also rises at time $t_0$ but does not fall until a later time $t_2$. Thus the feed motor speed, as indicated at curve 374 of FIG. 7(*c*) rises exponentially from time $t_0$ and at time $t_1$ begins to decay. Chuck motor speed begins to rise at time $t_0$. At time $t_1$, when the feed motor command signal drops to zero, the rotation motor signal continues at its same level because at this time a rotation command signal, commanding a negative rotation, is initiated on input line 306. Since the feed motor speed decays as indicated at 376 of FIG. 7(*c*) whereas the chuck motor speed continues at the same level as indicated at curve 378, negative chuck rotation, which is the difference between the two motor speeds, is initiated upon decay of the feed motor speed. Chuck rotation is indicated by curve 380 of FIG. 7(*e*). This negative direction of the chuck rotation occurs because chain 54 continues to move in a counterclockwise direction as viewed in FIG. 2 and carriage chain 254 also continues to move in a counterclockwise direction but at a lesser speed. Thus there is a net difference in chain speeds and this difference rotates sprocket 102 in a counterclockwise direction as viewed in FIG. 2. This is the assumed negative direction of chuck rotation. When the two chains are moving in the same direction to drive the carriage forward and the carriage chain 254 is moving at greater speed, rotation of sprocket 102 is in the clockwise direction, as viewed in FIG. 2, which is the assumed positive direction chuck rotation.

Upon termination of the rotation motor signal at time $t_2$ chuck motor speed begins to decay as indicated at curve 382 and thus chuck rotation also begins to decay as indicated at curve 384 of FIG. 7(*e*).

In general, for increased speed of operation it is desired to operate the drive motors at maximum speed.

The differential between the two motor speeds produces the chuck rotation. Thus maximum rotation occurs when the motor 250 is running at maximum speed and motor 50 is at zero or going in reverse. Further, operation of the chuck in the opposite direction could be achieved by running motor 50 faster than motor 250. However, since it is desired to always run the carriage motor 250 as fast as possible the machine is inherently biased in one direction.

It will be seen that the chuck may be rotated in an assumed positive direction of rotation at the same time that the carriage is advancing toward the bend head simply by operating solely carriage drive motor 250 and not operating chuck rotation motor 50. In other words if chain 254 is driven in a counterclockwise direction while chain 54 is at rest the carriage will be advanced and simultaneously the chuck will be rotated in the assumed positive direction of rotation.

However, negative chuck rotation cannot take place while the carriage is being advanced toward the bend head but, as indicated in the curve in FIG. 7(*e*) such negative chuck rotation is accomplished after the forward carriage drive has stopped (it may actually start upon decrease in carriage speed). In other words, the described arrangement has a relatively fast direction of chuck rotation and a relatively slow direction of chuck rotation. Fast and slow in this sense refer to the speed of complete (both feed and rotation) tube positioning. This directional bias is actually an advantage in tube bending machines since for a given bending machine a great majority of bends of a single pipe require rotation of the pipe or tube in but a single direction. A bending machine is set up to make either right-handed bends or left-handed bends. Certain changes are required to reposition dies on a given machine if bends of the opposite hand are to be made. This handedness of the machine derives from the fact that a portion of the tube that has already been bent may have such a configuration as to enable the tube to be rotated only in one direction without interference with the bending head or bending dies themselves. Thus, after making bends of certain types the tube may be rotated only in one direction without causing the already bent portions of the tube to contact the bending head. If the tube were to be rotated in the opposite direction those portions of the tube previously bent might very well interfere with the bending head. Therefore, a program of bends for a given multi-bend tube, such as the automobile exhaust pipe for example, is generally set up so as to enable the tube to be rotated in the same direction each time a subsequent bend is to be made. In those relatively few instances where a left-handed bend is to be made on a right-handed bend machine or vice versa the tube must be advanced to clear the bend head before the opposite sense rotation can take place.

To avoid such interference it is necessary to build into the program for a digitally programmed machine a delay in the opposite sense rotation or, in a manually controlled machine, to otherwise require the operator to insure that the tube is advanced before the opposite sense rotation takes place. With the present arrangement such sequential operation for the opposite sense of rotation is inherent in the machine. Thus, operator error or program error that would cause a negative rotation before the tube had cleared the bend head is avoided.

Figure 2:
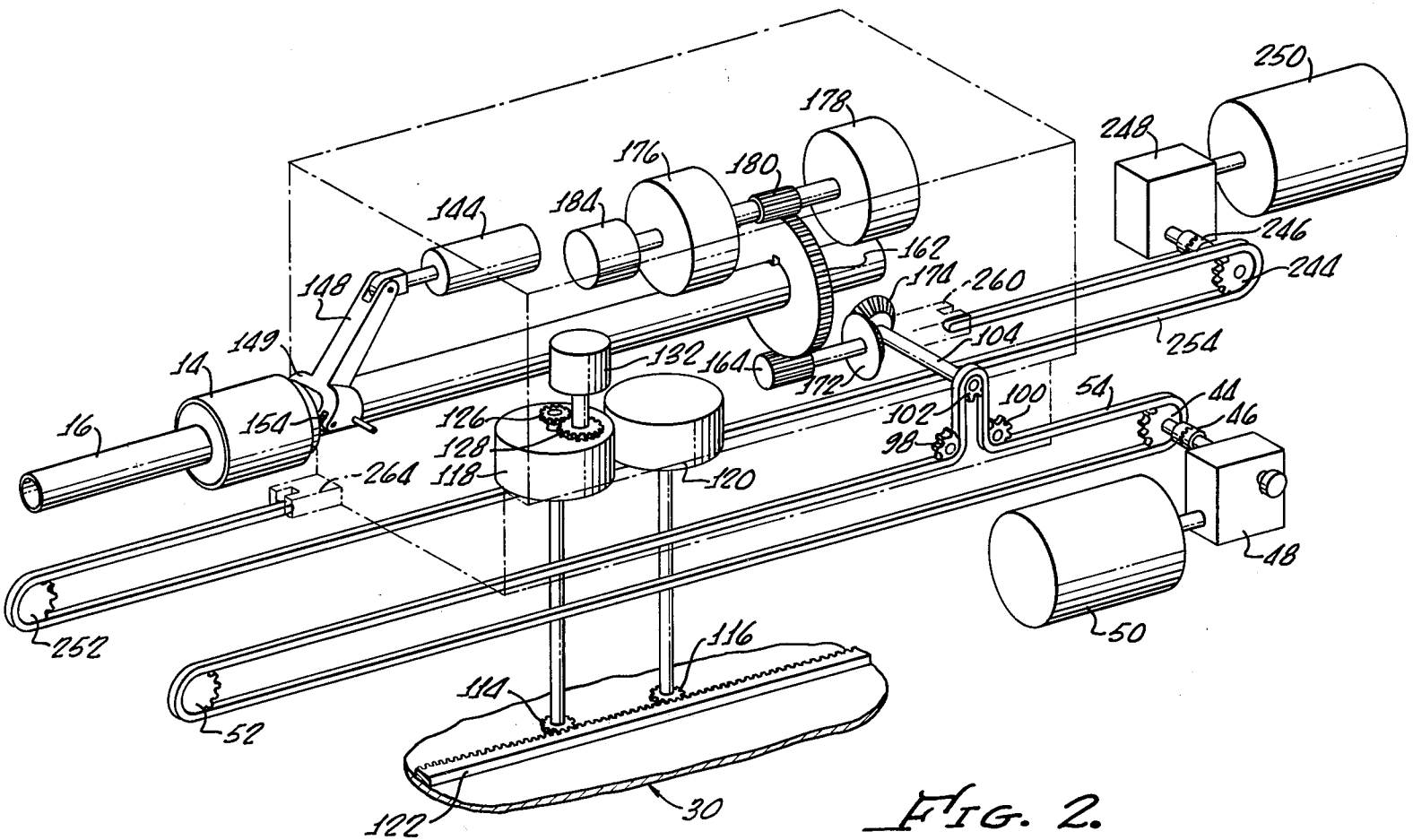
FIG. 2 is a simplified pictorial illustration of the dual motor drive of the bending machine of FIG. 1.
Figure 8:
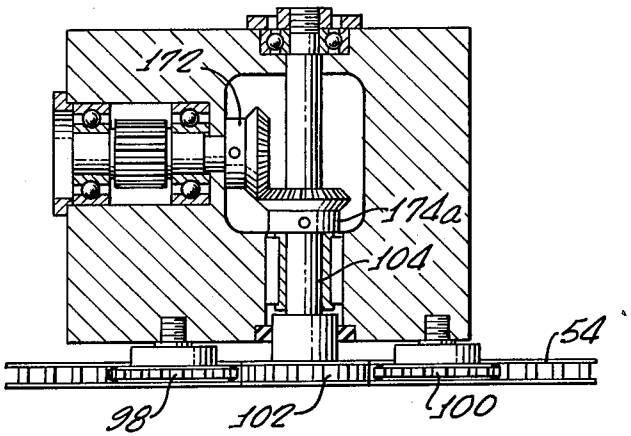
FIG. 8 illustrates the reversal of the direction of rotation bias of the machine of FIG. 1.

The arrangement of the described embodiment is, in effect, directionally biased to position the tube more rapidly when rotation is in the assumed positive direction. The direction of bias must be matched to the handedness of machine. Thus, the bias must be in one direction for a bending machine set up for right-handed bends and must be in the opposite direction for a machine set up for left-handed bends. The sense of bias of the machine is readily reversed as illustrated in FIG. 8 which shows a horizontal sectional view of the carriage with the rotation chain 54 driving the sprocket shaft 104. The latter, via bevel gear 174*a*, drives bevel gear 172 and thus the chuck power gear (not shown in FIG. 8). It will be noted that in the arrangement of FIG. 8 bevel gear 174*a* has been reversed (relative to position of gear 172 in FIG. 2) and moved along the shaft 104 so as to engage a point on the periphery of gear 172 that is closer to the chain 54. In the arrangement of FIG. 2 gear 174 engages a point on the periphery of gear 172 that is more remote from the chain 54. Thus the same direction of rotation of shaft 104 will drive the gear 172 of FIG. 2 in one direction and the gear 174*a* of FIG. 8 in the opposite direction. Accordingly, in order to change the direction of bias of the machine all that is necessary is to reposition the gear 174. As will be readily appreciated other modifications may be employed to change the chuck rotation.

Figure 9:
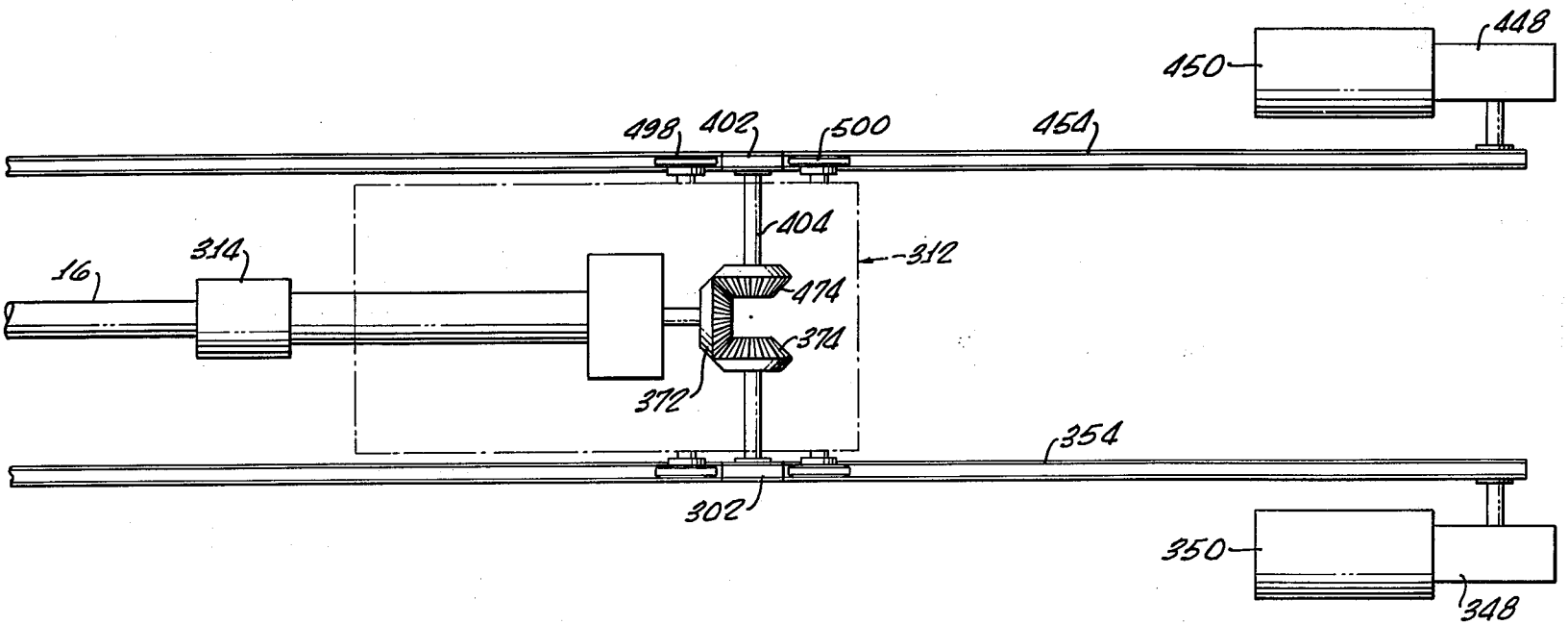
FIG. 9 is illustrates a modification of the machine of FIG. 1.

The arrangement illustrated in FIGS. 1, 2, 3 and 4 is presently preferred because it requires minimum modification of machines previously constructed as described in the above-identified U.S. Pat. Nos. 3,594,582 and 3,974,676. However, for still greater flexibility of carriage and chuck drive the arrangement may be modified as illustrated in FIG. 9. In this embodiment a rotation motor 350 and gear box 348 drive a first chain 354 which in turn is enmeshed with a first drive sprocket 302 journalled on the carriage 312 and connected to drive a bevel gear 374 which is engaged with a bevel gear 372, both journalled on the carriage. The bevel gear 372, like gear 172 of the previous embodiment is connected to drive the chuck 314. A second motor 450, which is also stationary, as are all the other motors referred to herein, is connected by a gear box 448 to drive a second chain 454. Instead of being fixed to the carriage 312, the second chain 454 is connected thereto in a manner identical to the connection of the chain 354 to the carriage and chuck. Chain 454 engages a pair of idler wheels or sprockets 498 and 500 and a second drive sprocket 402 interposed between the idler sprockets. Second drive sprocket 402, which is journalled on the other side of the carriage 312, is fixed to a second drive shaft 404 that is connected to a third bevel gear 474. The latter is engaged with the other side of gear 372 to provide a differential action. As in a conventional differential the gear 372 may be driven in one direction or the other by the differential rotation of gears 474 and 374. Further, motion of the two chains 354 and 454 in the same direction and at the same speed will cause both motors to drive the carriage without rotation of the chuck. Differential motion of the two chains with one going faster than the other will cause chuck rotation in one direction or the other. Motion of only one chain will rotate the chuck but not move the carriage. Rotation of both chains in the same direction but at different speeds will achieve both carriage motion and chuck rotation. Thus, in the arrangement of FIG. 9 simultaneous rotation of the chuck and motion of the carriage may be achieved with the chuck rotating in either direction and the machine thus may be operated without the above-described chuck rotation bias.

It will be seen that the described arrangements provide a positioning system in which two stationary motors provide increased speed of operation by driving both carriage and chuck at the same time. The motors also work in unison and provide greater power for driving one or the other of the two driven elements. In the embodiment of FIG. 9 either the chuck or the carriage may be driven by the combined power of both motors. The carriage is driven by both motors when the two chains are operated at the same velocities. The chuck is driven by both motors when the two chains are driven in opposite directions. Driving the two chains in opposite directions at the same speeds will rotate the chuck without motion of the carriage.

The increased force of the two motors working in unison is available to forceably remove the tube from a die, to forcibly insert a mandrel into a tube, and to forcibly withdraw the mandrel from a tube. The arrangement also enables simultaneous operation of both carriage and chuck to thereby greatly increase the speed of positioning. Since two motors and two drives are employed, each motor and drive may be operated considerably below its rated capacity, thus avoiding undue stress and strain on the motors and the drive components but at the same time providing a greatly increased available power. Since the machine is inherently faster than the machine of the above-mentioned patents accelerations and decelerations can be changed to make them less severe thus imposing less strain on the drive components.

The foregoing detailed description is to be clearly understood as given by way of illustration and example only, the spirit and scope of this invention being limited solely by the appended claims.

I claim:

1. A bending machine comprising
a machine body,
bending head means mounted adjacent said body for bending an elongated workpiece presented thereto, and
means for presenting an elongated workpiece to the bending head means at selected axial and rotational positions of the workpiece, said means for presenting comprising
a carriage movable on the machine body,
rotatable chuck means journalled on the carriage for grasping and axially rotating a workpiece for presentation to the bending head means,
a first elongated driven element,
first drive means coupled with said driven element for independently rotating said chuck means or moving said carriage along said body,
a second elongated driven element, and
second drive means coupled with said second driven element for moving said carriage along said body, whereby said carriage may be moved by both of said driven elements together or by one of said driven elements while the other rotates said chuck means.

2. The bending machine of claim 1 wherein said first drive means comprises a drive wheel journalled on said carriage, power gear means journalled on said carriage and connected with said chuck means, and means on said carriage for rotating said power gear means in response to rotation of said drive wheel.

3. The bending machine of claim 2 wherein said first driven element comprises a chain, and wherein said drive wheel comprises a sprocket enmeshed with said chain.

4. The machine of claim 2 wherein said second drive means comprises means for providing a fixed connection between said carriage and said second driven element.

5. The machine of claim 2 wherein said second drive means comprises a second drive wheel journalled on said carriage, means on said carriage for rotating said power gear means in response to rotation of said second drive wheel, said second driven element being coupled with said second drive wheel to effect rotation thereof, whereby said power gear means may be rotated by differential rotation of said first and second drive wheels and said carriage may be moved by like components of motion of said first and second driven elements.

6. The machine of claim 1 including first and second motors, respectively, connected to drive said first and second driven elements, means for transmitting first and second command signals to said first and second motors respectively, and means for combining one of said command signals with the other before transmission of said one signal to its associated motor.

7. The machine of claim 1 wherein said first driven element comprises a tension member, and wherein said first drive means comprises gear means on said carriage connected to said tension member to be rotated thereby upon relative motion of said tension member and carriage and to move with said tension member when the latter moves with said carriage.

8. The machine of claim 7 wherein said second driven element comprises a second tension member connected to said carriage.

9. The machine of claim 7 wherein said second driven element comprises a second tension member and wherein said second drive means comprises second gear means on said carriage connected to said second tension member and to said first mentioned gear means for rotation relative to said second tension member in response to motion of said carriage relative to said second tension member and for motion with said carriage upon motion of said second tension member with said carriage.

10. The machine of claim 7 including first and second motors for actuating said first and second driven elements, respectively, means for transmitting rotation and feed command signals to said first and second motors, respectively, and means for transmitting to one of said motors a signal that is a function of the signal transmitted to the other of said motors.

11. The bending machine of claim 1 wherein motion of said carriage produces a change of rotational response of said chuck means to motion of said first driven element, and including means for modifying rotation of said chuck means to compensate for said changes of rotational response.

12. Remotely operable dual driving apparatus comprising
a first driven member movable along a path,
a drive wheel journalled on the driven member,
a second driven member movably mounted on the first driven member,
means interconnected between the drive wheel and the second driven member for moving the second driven member in response to rotation of the drive wheel,
a first drive member in driving engagement with said drive wheel, means for actuating said first drive member to drive said drive wheel, a second drive member, means for coupling said second drive member to said first driven member, and means for actuating said second drive member to drive said first driven member, whereby said first driven member may be moved along said path by like components of motion of said first and second drive members and whereby said second driven member may be moved relative to said first driven member by differential motion of said first and second drive members.

13. The apparatus of claim 12 wherein said first driven member is a tube bending machine carriage, wherein said second driven member is a tube grasping chuck rotatably mounted on the carriage, and wherein said first and second drive members comprise first and second chains.

14. The apparatus of claim 12 wherein said means for actuating said drive members comprises means for actuating one of said drive members in accordance with a first control signal and means for actuating the other of said drive members in accordance with the combination of a second control signal and said first control signal.

15. The apparatus of claim 12 wherein motion of said first driven member produces a change of response of said drive wheel to motion of said first drive member and including means for modifying motion of said second driven member to compensate for said change.

16. The apparatus of claim 12 wherein said means for coupling said second drive member to said first driven member includes means for also coupling said second drive member to said second driven member.

17. The apparatus of claim 12 wherein said actuating means comprises first and second motors for driving said first and second drive members, respectively, means for actuating one of said motors in accordance with a first control signal, and means for actuating the other of said motors in accordance with both said first control signal and a second control signal, whereby both said motors may be actuated in unison by said second control signal and the motors may be separately actuated by respective ones of said first and second control signals.

18. A tube bending machine comprising a machine body, a bending head mounted adjacent said body for bending a tube presented thereto, and means for presenting a tube to the bending head at selected axial and rotational positions of the tube, said means for presenting comprising a carriage movably mounted on the machine body, a rotatable chuck journalled on the carriage and adapted to grasp and axially rotate a tube for presentation to the bending head, a first driven chain, a sprocket journalled on the carriage and enmeshed with said chain, gear means connected between said rotatable chuck and said sprocket for rotating said chuck in response to rotation of said sprocket, and a second driven chain connected to be driven independently of said first chain and having a portion thereof fixedly connected to said carriage, whereby said carriage may be driven by one or both of said chains and said chuck may be driven by differential driving of said chains.

19. The tube bending machine of claim 18 including a first motor for driving said first chain, a second motor for driving said second chain, means for transmitting a first control signal to said first motor, means for transmitting a second control signal to said second motor, and means for transmitting to said first motor a third control signal that is a function of said second control signal, whereby both said motors may be driven by said second and third control signals to drive said carriage from both motors and whereby said chuck and carriage may be driven at the same time.

20. The tube bending machine of claim 18 wherein motion of said carriage produces a change of rotational response of said chuck to motion of said first chain, and including means for modifying motion of said first chain to compensate for said change of rotational response.

21. A bending machine comprising a machine body, bending head means mounted adjacent said body for bending an elongated work piece presented thereto, and means for presenting an elongated work piece to the bending head means at selected axial and rotational positions of the work piece, said means for presenting comprising a carriage movable on the machine body, rotatable chuck means journalled on the carriage for grasping and axially rotating a work piece for presentation to the bending head means, differential gear means mounted on said carriage and including first and second differential gears for rotating said chuck means in accordance with the differential rotation of said first and second gears, first and second sprockets journalled on said carriage and connected to said first and second differential gears respectively, first and second driven chains enmeshed with said first and second sprockets respectively, whereby said carriage may be driven by one or both of said chains, and whereby said chuck and carriage may be driven simultaneously or one at a time.

22. In a tube bending machine having a body and a bending head connected with the body for bending a tube presented to the bending head at selected axial and rotational positions of the tube, improved apparatus for presenting the tube to the bending head comprising a track mounted on the machine body, a carriage mounted for motion along said track, a tube holding chuck rotatably mounted upon said carriage, a drive sprocket journalled on the carriage, motion transmitting means interconnected between the chuck and the drive sprocket for rotating the chuck in response to rotation of the sprocket, a first drive chain movably mounted for motion along the track and engaged with said drive sprocket, and a second drive chain movably mounted for motion along the track and having a driving connection with said carriage.

23. The apparatus of claim 22 wherein said motion transmitting means comprises a plurality of mutually engaged gears including a first gear connected to said drive sprocket and a second gear connected to said chuck.

24. The apparatus of claim 23 wherein said driving connection of said second chain with said carriage comprises a second drive sprocket journalled on the carriage and engaged with said second drive chain, and a third gear connected to said second sprocket and engaged with said second gear.

25. The apparatus of claim 23 including first and second motors connected to drive said first and second chains, respectively, means for generating a rotation signal and a feed signal, means for algebraically adding said signals to produce a combined signal, means responsive to said combined signal for energizing said first motor, and means responsive to said feed signal for energizing said second motor.

26. The method of positioning a tube at the bending head of a tube bending machine that has a tube advancing carriage, a tube rotating chuck on the carriage, and first and second drive motors, said method comprising the steps of employing both motors to drive the carriage for an initial part of the tube advance required to longitudinally position the tube for a selected bend, and thereafter initiating drive of said chuck from one of said motors while continuing drive of said carriage from the other motor.

27. The method of claim 26 including the step of providing a mechanical differential connecting said motors to said carriage and chuck, driving the carriage from both motors by operating the motors at the same equivalent velocities and driving the chuck by operating the motors at relatively different equivalent velocities.

28. The method of claim 26 including the step of rotating said chuck in a first direction by decreasing the speed of a first one of said motors, and rotating the chuck in an opposite direction by decreasing the speed of the other of said motors.

29. The method of claim 27 including the steps of driving one of said motors in accordance with a desired carriage position, driving the other of said motors in accordance with a desired chuck position, and modifying the driving of said other motor in accordance with said desired carriage position.

30. The method of positioning a tube at the bending head of a tube bending machine that has a tube advancing carriage, a tube rotating chuck on the carriage, and first and second drive motors, said method comprising the steps of providing a mechanical differential connecting said motors to said chuck and to said carriage, driving said motors at mutually equivalent velocities to thereby drive said carriage from both motors, and driving said motors at relatively different velocities to thereby drive said chuck.

31. The method of claim 30 including the step of modifying the driving of said chuck to compensate for response of said chuck to motion of said carriage.

32. The method of claim 31 wherein said step of modifying comprises driving said first and second motors from feed and rotation signals respectively, and modifying the drive of said second motor in accordance with said feed signal.

* * * * *